US007632010B2

(12) United States Patent
Liu et al.

(10) Patent No.: US 7,632,010 B2
(45) Date of Patent: Dec. 15, 2009

(54) PERFORMANCE TESTING APPARATUS FOR HEAT PIPES

(75) Inventors: Tay-Jian Liu, Tu-Cheng (TW); Chuen-Shu Hou, Tu-Cheng (TW); Xiao-Long Li, Shenzhen (CN); Chao-Nien Tung, Tu-Cheng (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 348 days.

(21) Appl. No.: 11/309,567

(22) Filed: Aug. 24, 2006

(65) Prior Publication Data

US 2007/0286258 A1 Dec. 13, 2007

(30) Foreign Application Priority Data

Jun. 9, 2006 (CN) ..... 2006 1 0061077

(51) Int. Cl.
*G01K 1/16* (2006.01)
*G01K 25/00* (2006.01)

(52) U.S. Cl. ..... 374/44; 374/29; 374/137; 374/208; 374/5; 374/57; 374/147

(58) Field of Classification Search ..... 374/4, 374/5, 29–32, 43–44, 57, 137, 147, 152, 374/153, 141, 143, 145, 179, 208, 112
See application file for complete search history.

(56) References Cited

U.S. PATENT DOCUMENTS 7,147,368 B2 * 12/2006 Chien ..... 374/147

FOREIGN PATENT DOCUMENTS

CN 101086488 A 12/2007

* cited by examiner

*Primary Examiner*—Gail Verbitsky
(74) *Attorney, Agent, or Firm*—Frank R. Niranjan

(57) ABSTRACT

A performance testing apparatus for a heat pipe includes an immovable portion and a movable portion each having a heating member located therein for heating an evaporating section of the heat pipe. The movable portion is capable of moving relative to the immovable portion. A receiving structure is defined between the immovable portion and the movable portion for receiving the evaporating section therein. A positioning structure extends from the immovable portion toward the movable portion to ensure the receiving structure being capable of precisely receiving the heat pipe. Temperature sensors are attached to the immovable and movable portions for detecting temperature of the heat pipe. An enclosure encloses the immovable portion and the movable portions therein, and defines a space therein for movement of the movable portion relative to the immovable portion.

19 Claims, 11 Drawing Sheets

PERFORMANCE TESTING APPARATUS FOR HEAT PIPES

FIELD OF THE INVENTION

The present invention relates generally to testing apparatuses, and more particularly to a performance testing apparatus for heat pipes.

DESCRIPTION OF RELATED ART

It is well known that a heat pipe is generally a vacuum-sealed pipe. A porous wick structure is provided on an inner face of the pipe, and phase changeable working media employed to carry heat is included in the pipe. Generally, according to where the heat is input or output, a heat pipe has three sections, an evaporating section, a condensing section and an adiabatic section between the evaporating section and the condensing section.

In use, the heat pipe transfers heat from one place to another place mainly by exchanging heat through phase change of the working media. Generally, the working media is a liquid such as alcohol or water and so on. When the working media in the evaporating section of the heat pipe is heated up, it evaporates, and a pressure difference is thus produced between the evaporating section and the condensing section in the heat pipe. The resultant vapor with high enthalpy rushes to the condensing section and condenses there. Then the condensed liquid reflows to the evaporating section along the wick structure. This evaporating/condensing cycle continually transfers heat from the evaporating section to the condensing section. Due to the continual phase change of the working media, the evaporating section is kept at or near the same temperature as the condensing section of the heat pipe. Heat pipes are used widely owing to their great heat-transfer capability.

In order to ensure the effective working of the heat pipe, the heat pipe generally requires testing before being used. The maximum heat transfer capacity (Qmax) and the temperature difference ($\Delta T$) between the evaporating section and the condensing section are two important parameters in evaluating performance of the heat pipe. When a predetermined quantity of heat is input into the heat pipe through the evaporating section thereof, thermal resistance (Rth) of the heat pipe can be obtained from $\Delta T$, and the performance of the heat pipe can be evaluated. The relationship between these parameters Qmax, Rth and $\Delta T$ is $Rth=\Delta T/Qmax$. When the input quantity of heat exceeds the maximum heat transfer capacity (Qmax), the heat cannot be timely transferred from the evaporating section to the condensing section, and the temperature of the evaporating section increases rapidly.

A typical method for testing the performance of a heat pipe is to first insert the evaporating section of the heat pipe into a liquid at constant temperature; after a period of time the temperature of the heat pipe will become stable, then a temperature sensor such as a thermocouple, a resistance thermometer detector (RTD) or the like can be used to measure $\Delta T$ between the liquid and the condensing section of the heat pipe to evaluate the performance of the heat pipe. However, Rth and Qmax can not be obtained by this test, and the performance of the heat pipe can not be reflected exactly by this test.

Referring to FIG. 8, a related performance testing apparatus for heat pipes is shown. The apparatus has a resistance wire 1 coiling round an evaporating section 2*a* of a heat pipe 2, and a water cooling sleeve 3 functioning as a heat sink and enclosing a condensing section 2*b* of the heat pipe 2. In use, electrical power controlled by a voltmeter and an ammeter flows through the resistance wire 1, whereby the resistance wire 1 heats the evaporating section 2*a* of the heat pipe 2. At the same time, by controlling flow rate and temperature of cooling liquid entering the cooling sleeve 3, the heat input at the evaporating section 2*a* can be removed from the heat pipe 2 by the cooling liquid at the condensing section 2*b*, whereby a stable operating temperature of adiabatic section 2*c* of the heat pipe 2 is obtained. Therefore, Qmax of the heat pipe 2 and $\Delta T$ between the evaporating section 2*a* and the condensing section 2*b* can be obtained by temperature sensors 4 at different positions on the heat pipe 2.

However, in the test, the related testing apparatus has the following drawbacks: a) it is difficult to accurately determine lengths of the evaporating section 2*a* and the condensing section 2*b* which are important factors in determining the performance of the heat pipe 2; b) heat transference and temperature measurement may easily be affected by environmental conditions; and, c) it is difficult to achieve sufficiently intimate contact between the heat pipe and the heat source and between the heat pipe and the heat sink, which results in uneven performance test results of the heat pipe. Furthermore, due to awkward and laborious assembly and disassembly in the test, the testing apparatus can be only used in the laboratory, and can not be used in the mass production of heat pipes.

In mass production of heat pipes, a large number of performance tests are needed, and the apparatus is used frequently over a long period of time; therefore, the apparatus not only requires good testing accuracy, but also requires easy and accurate assembly to the heat pipes to be tested. The testing apparatus affects the yield and cost of the heat pipes directly; therefore, testing accuracy, facility, speed, consistency, reproducibility and reliability need to be considered when choosing the testing apparatus. Therefore, the testing apparatus needs to be improved in order to meet the demand for mass production of heat pipes.

What is needed, therefore, is a high performance testing apparatus for heat pipes suitable for use in mass production of heat pipes.

SUMMARY OF THE INVENTION

A performance testing apparatus for a heat pipe in accordance with a preferred embodiment of the present invention comprises an immovable portion having a first heating member located therein for heating an evaporating section of the heat pipe requiring test. A movable portion is capable of moving relative to the immovable portion and has a second heating member located therein for heating the evaporating section of the heat pipe. A receiving structure is defined between the immovable portion and the movable portion for receiving the evaporating section of the heat pipe therein. A positioning structure extends from at least one of the immovable portion and the movable portion for avoiding the movable portion from deviating from the immovable portion during movement of the movable portion relative to the immovable portion to ensure the receiving structure being capable of precisely receiving the heat pipe. At least one temperature sensor is attached to at least one of the immovable portion and the movable portion for thermally contacting the heat pipe in the receiving structure for detecting temperature of the heat pipe. An enclosure encloses the immovable portion and the movable portions therein, and defines a space therein for movement of the movable portion relative to the immovable portion.

Other advantages and novel features will become more apparent from the following detailed description of preferred embodiments when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
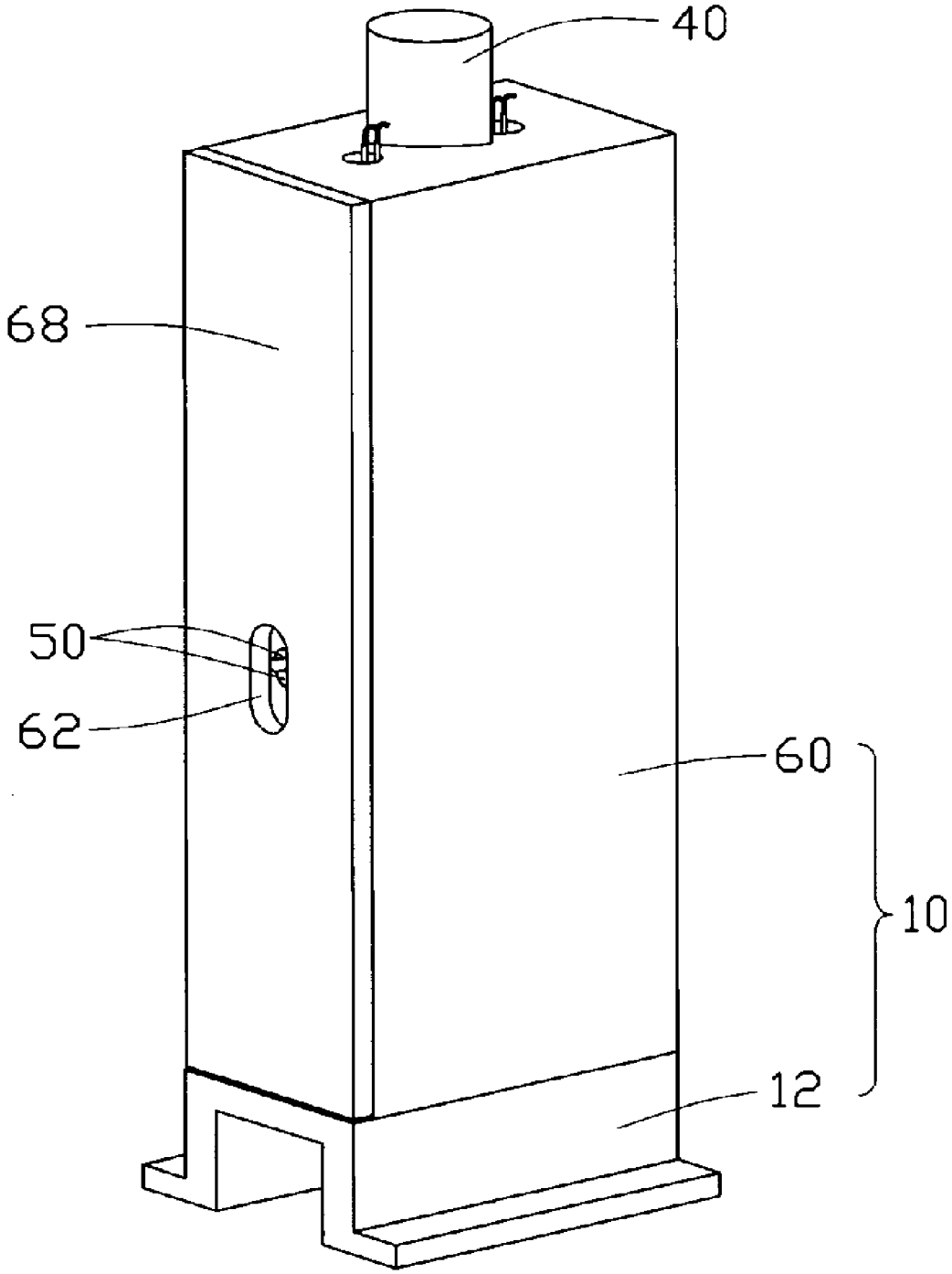
FIG. 1 is an assembled view of a performance testing apparatus for heat pipes in accordance with a first embodiment of the present invention.
Figure 2:
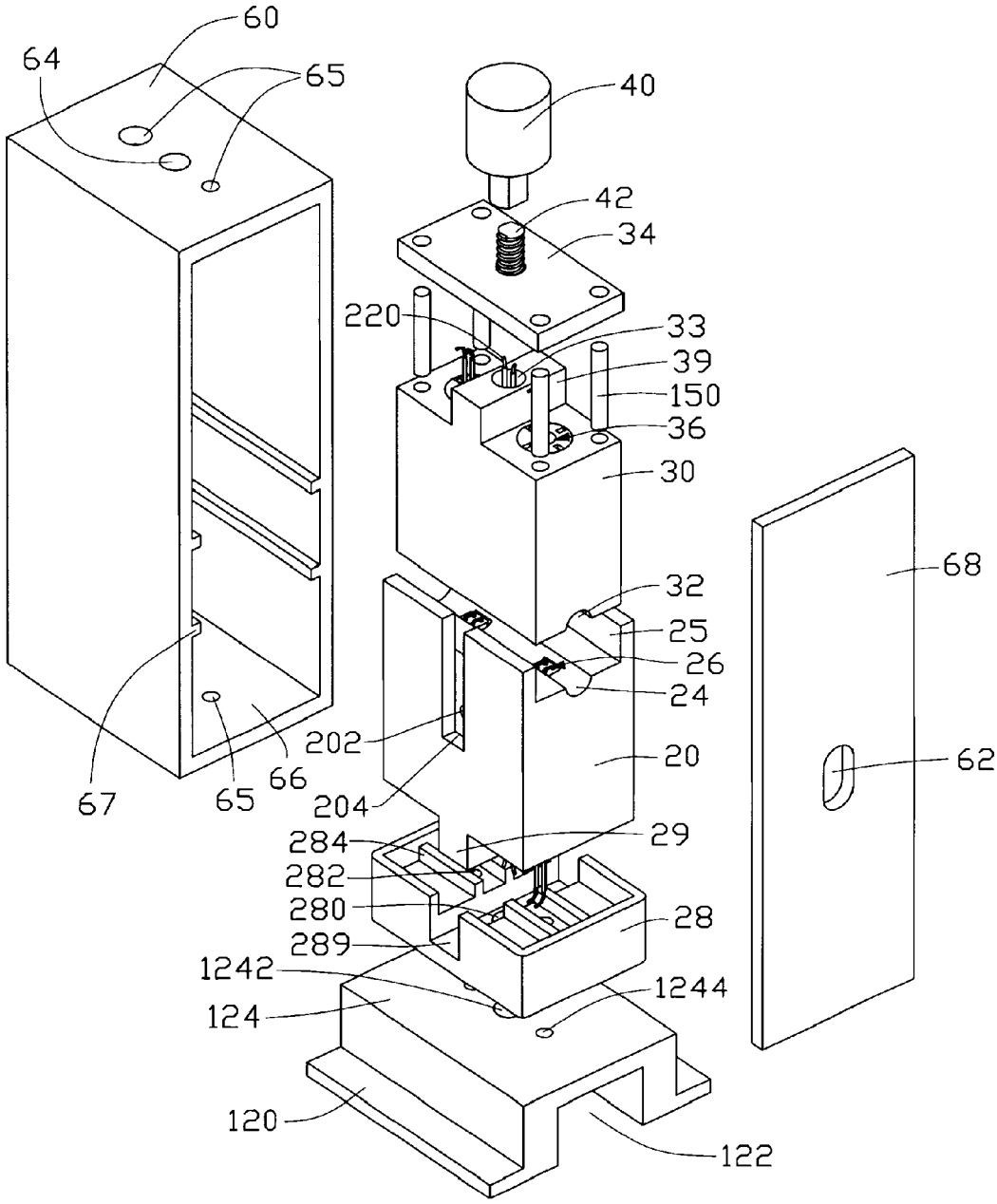
FIG. 2 is an exploded, isometric view of the testing apparatus of FIG. 1.

Referring to FIGS. 1 and 2, a performance testing apparatus for heat pipes comprises an immovable portion 20 and a movable portion 30 movably mounted on the immovable portion 20. The performance testing apparatus is to be held on a platform of a supporting member such as a testing table or so on.

Figure 3A:
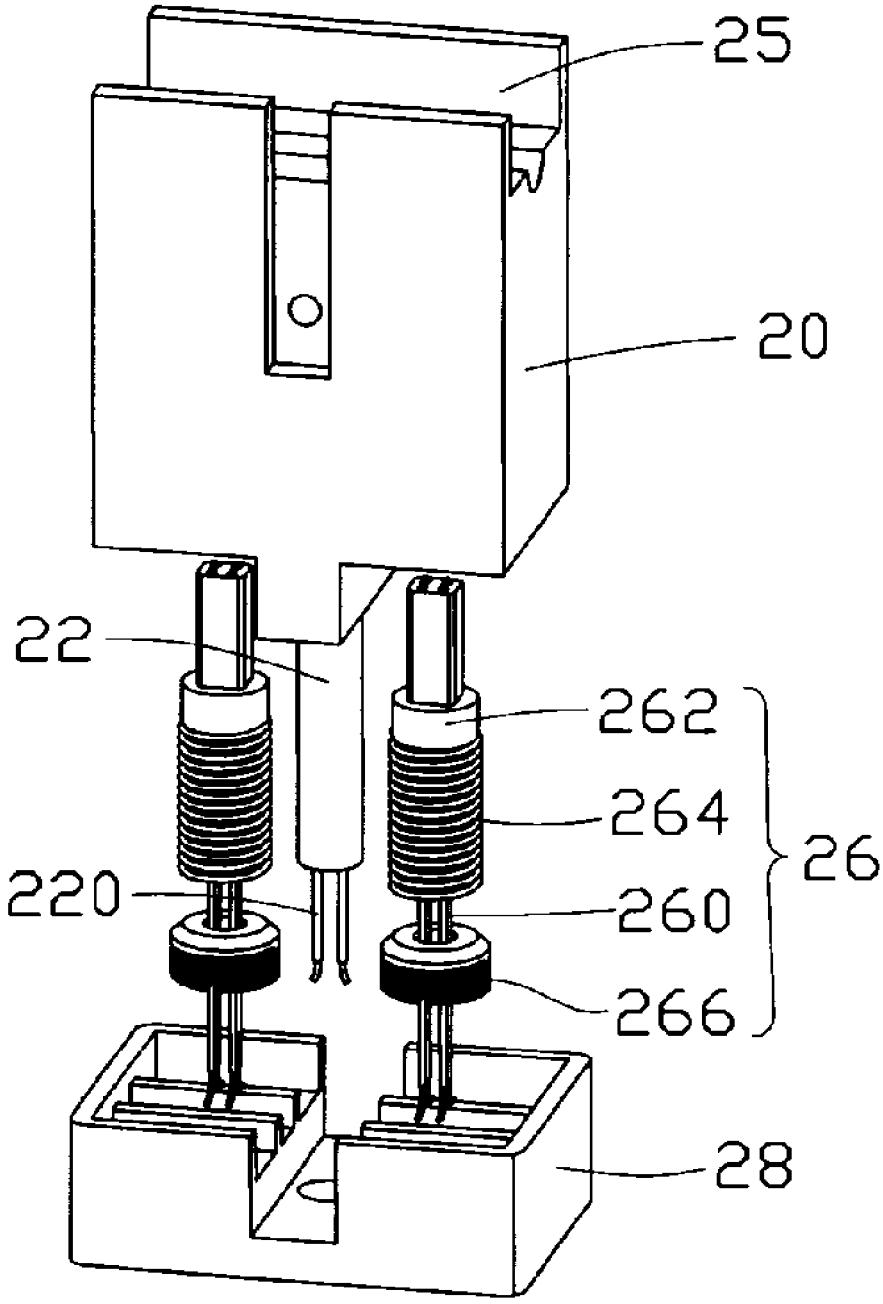
FIG. 3A shows an immovable portion, a thermally insulating member and two temperature sensors of the testing apparatus of FIG. 2 viewed from another aspect.
Figure 3B:
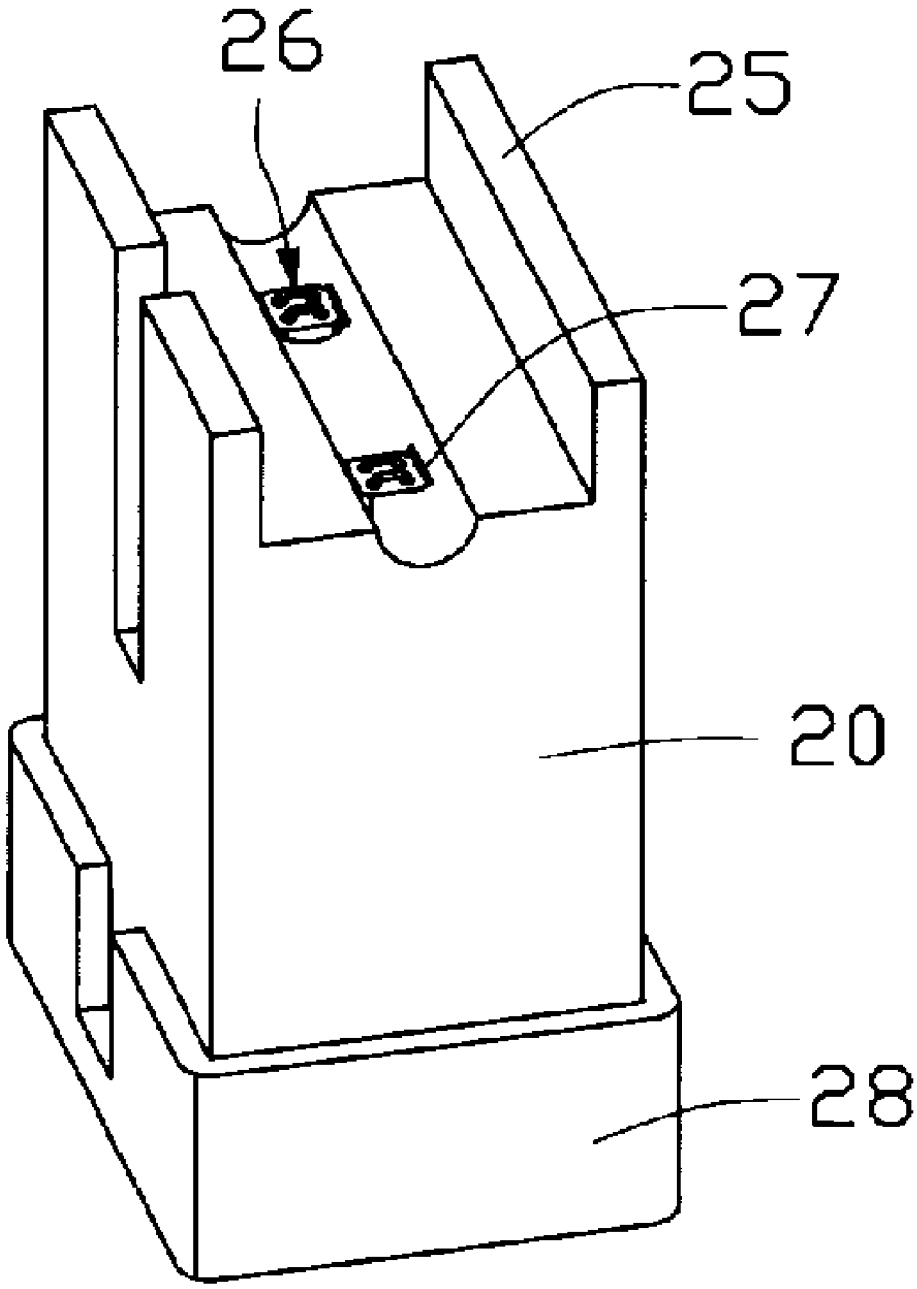
FIG. 3B is an assembled view of FIG. 3A viewed from different aspect.

Referring also to FIGS. 3A and 3B, the immovable portion 20 is made of material having good heat conductivity. A first heating member 22 such as an immersion heater, resistance coil, quartz tube and Positive temperature coefficient (PTC) material or the like is embedded in the immovable portion 20. The immovable portion 20 has a central portion thereof extending an extension 29 downwardly. The immovable portion 20 defines a hole (not shown) in the extension 29. In this case, the first heating member 22 is an elongated cylinder. The first heating member 22 is accommodated in the hole of the immovable portion 20. Two spaced wires 220 extend beyond the extension 29 from a bottom end of the first heating member 22 for connecting with a power supply (not shown). The immovable portion 20 has a heating groove 24 defined in a top face thereof, for receiving an evaporating section of the heat pipe to be tested therein. Two temperature sensors 26 are accommodated in two through holes 27 defined in the immovable portion 20 at two sides of the extension 29. Each of the two temperature sensors 26 comprises a positioning socket 262 fitted in the hole 27 and a pair of thermocouple wires 260 fitted in the socket 262. A spring coil 264 surrounds a lower portion of the thermocouple wires 260. The spring coil 264 is compressed by a screw 266 engaged in the hole 27 of the immovable portion 20. A lower portion of the thermocouple wires 260 extend through an opening (not labeled) of the screw 266 to connect with a monitoring computer (not shown). The thermocouple wires 260 have detecting sections (not labeled) located in the groove 24. The detecting sections are capable of automatically contacting the heat pipe to detect the temperature of the evaporating section of the heat pipe.

The movable portion 30 is also made of material having good heat conductivity. The movable portion 30 has an extension 39 extending upwardly from a middle of a top surface thereof. The movable portion 30 defines a hole 33 in the extension 39. A second heating member (not shown) is accommodated in the hole 33 of the movable portion 30. Two spaced wires 220 extend from a top end of the second heating member beyond the extension 39 for connecting with the power supply. The movable portion 30, corresponding to the heating groove 24 of the immovable portion 20, has a heating groove 32 defined therein, whereby a testing channel 50 is cooperatively defined by the heating grooves 24, 32 when the movable portion 30 moves to reach the immovable portion 20. Thus, an intimate contact between the heat pipe and the movable and immovable portions 30, 20 defining the channel 50 can be realized, thereby reducing heat resistance between the heat pipe and the movable and immovable portions 30, 20. The movable portion 30 has two through holes (not labeled) communicating with the heating groove 32 and defined at two opposite sides of the second heating member. Two temperature sensors 36 are accommodated in the two through holes, respectively. Each of the two temperature sensors 36, which has a structure similar to that of the temperature sensor 26, has detecting sections (not labeled) located in the heating groove 32. The detecting sections are capable of automatically contacting the heat pipe to detect the temperature of the evaporating section of the heat pipe.

The immovable portion 20 has two flanges 25 integrally extending upwardly from two opposite edges thereof and toward the movable portion 30. An outer face of each flange 25 is coplanar with a corresponding outer face of a main body (not labeled) of the immovable portion 20. The two flanges 25 function as positioning structure to position the movable portion 30 therebetween, thereby preventing the movable portion 30 from deviating from the immovable portion 20 during test of the heat pipes in mass production. The two flanges 25 ensure the grooves 24, 32 of the immovable and movable portions 20, 30 to always be aligned with each other. Thus, the channel 50 can be always precisely and easily formed for receiving the heat pipe for test. The movable portion 30 slidably contacts the two flanges 25 of the immovable portion 20 when it moves relative to the immovable portion 20. Alternatively, the movable portion 30 can have two flanges slidably engaging two opposite sides of the immovable portion 20 to keep the immovable portion 20 aligned with the movable portion 30.

The channel 50 as shown in the first embodiment has a circular cross section enabling it to receive the evaporating section of the heat pipe having a correspondingly circular cross section. Alternatively, the channel 50 can have a rectangular cross section when the evaporating section of the heat pipe also has a flat rectangular configuration.

In order to ensure that the heat pipe is in close contact with the movable and immovable portions 30, 20, a supporting frame 1 0 is used to support and assemble the immovable and movable portions 20, 30. The immovable portion 20 is fixed on the supporting frame 10. A driving device 40 is installed on the supporting frame 10 to drive the movable portion 30 to make accurate linear movement relative to the immovable portion 20 along a vertical direction, thereby realizing the intimate contact between the heat pipe and the movable and immovable portions 30, 20. In this manner, heat resistance between the evaporating section of the heat pipe and the movable and immovable portions 30, 20 can be minimized.

The supporting frame 10 comprises a seat 12. The seat 12 comprises a supporting plate 124 at a top thereof and two feet 120 depending from the supporting plate 124. A space 122 is defined between the two feet 120 for extension of the wires 220 of the first heating member 22 and the wires 260 of the temperature sensors 26. In order to construct a thermally steady environment for testing the evaporating sections of the heat pipes, the supporting frame 10 further comprises a cuboidal enclosure 60 enclosing the immovable and movable portions 20, 30 therein. The enclosure 60 has a bottom 66 positioned on the supporting plate 124 and three interconnecting sidewalls (not labeled) extending upwardly from the bottom 66. An entrance (not labeled) is defined in an opened side of the enclosure 60 for disposing/displacing the movable portion 30 and the immovable portion 20 into/away from the enclosure 60. A door board 68 is removably attached to the entrance after the immovable portion 20 and the movable portion 30 are mounted in the enclosure 60, thereby enclosing the immovable portion 20 and the movable portion 30 in the enclosure 60. Corresponding to the channel 50 between the immovable portion 20 and the movable portion 30, openings 62 are defined in one of the sidewalls and the door board 68 of the enclosure 60. A pair of the sidewalls each extends two spaced ribs 660 toward the immovable portion 20 to position the immovable portion 20 between the pair of sidewalls. A top wall (not labeled) of the enclosure 60 defines a through hole 64 for a shaft of the driving device 40 extending therethrough. Two apertures 65 are defined at two sides of the through hole 64 in the top wall to allow the wires (not labeled) of the temperature sensors 36 and the wires 220 of the second heating member to extend therethrough to connect with the monitoring computer and the power supply. In order to prevent heat in the immovable portion 20 from spreading to the enclosure 60, a thermally insulating member 28 is located at the bottom of the immovable portion 20. The insulating member 28 receives the bottom of the immovable portion 20 therein. The insulating member 28, corresponding to the extension 29 of the immovable portion 20, defines a concave 289 receiving the extension 29 therein. At two sides of the concave 289, a plurality of ribs 284 extends from a bottom of the insulating member 28 to support the bottom of the immovable portion 20 thereon. The insulating member 28, the bottom 66 of the enclosure 60 and the supporting plate 124 define corresponding through holes 280, 1242, and through apertures 65, 282, 1244 therein, wherein the through hole defined in the bottom 66 is not shown, for the wires 220 of the first heat member 22 and the wires 260 of the temperature sensors 26 of the immovable portion 20 to extend therethrough to connect with the power supply and the monitoring computer. A board 34 is positioned over the movable portion 30. Four columns 150 are secured at corresponding four corners of the movable portion 30 and extend upwardly to engage in corresponding four through holes (not labeled) defined in four corners of the board 34. A space (not labeled) is defined between the extension 39 and the board 34 for extension of the wires 220 of the second heating member. The driving device 40 is fixed on the top wall of the enclosure 60. A shaft of the driving device 40 extends through the hole 64 and threadedly engages with a bolt 42 secured to the board 34 of the movable portion 30. A space (not labeled) is defined between the board 34 and the top wall of the enclosure 60 for movement of the movable portion 30. When the driving device 40 operates, the shaft rotates, the bolt 42 with the board 34, and the movable portion 30 move upwardly or downwardly relative to the immovable portion 20 in the enclosure 60.

The driving device 40 in the first embodiment is a step motor, although it can be easily apprehended by those skilled in the art that the driving device 40 can also be a pneumatic cylinder or a hydraulic cylinder. In use, the driving device 40 accurately drives the movable portion 30 to move linearly relative to the immovable portion 20. For example, the movable portion 30 can be driven to depart a certain distance such as 5 millimeters from the immovable portion 20 to facilitate the insertion of the evaporating section of the heat pipe being tested into the channel 50 or withdrawn from the channel 50 after the heat pipe has been tested. On the other hand, the movable portion 30 can be driven to move toward the immovable portion 20 to thereby realize an intimate contact between the evaporating section of the heat pipe and the immovable and movable portions 20, 30 during the test. Accordingly, the requirements for testing, i.e. accuracy, ease of use and speed, can be realized by the testing apparatus in accordance with the present invention.

It can be understood, positions of the immovable portion 20 and the movable portion 30 can be exchanged, i.e., the movable portion 30 is located on the insulating member 28, the immovable portion 20 is positioned on the movable portion 30, and the driving device 40 is positioned to be adjacent to the movable portion 20. In addition, each of the immovable and movable portions 20, 30 may have one driving device 40 installed thereon to move them toward/away from each other.

In use, the evaporating section of the heat pipe is received in the channel 50 from the opening 62 of the enclosure 60 when the movable portion 30 moves away from the top face of the immovable portion 20 between two flanges 25. Then the movable portion 30 moves to reach the top face of the immovable portion 20 so that the evaporating section of the heat pipe is tightly fitted into the channel 50. The sensors 26, 36 are in thermal contact with the evaporating section of the heat pipe; therefore, the sensors 26, 36 work to accurately send detected temperatures from the evaporating section of the heat pipe to the monitoring computer. Based on the temperatures obtained by the plurality of sensors 26, 36, an average temperature can be obtained by the monitoring computer very quickly; therefore, performance of the heat pipe can be quickly decided.

In order to prevent the immovable portion 20 from overheating, another temperature sensor (not shown) is accommodated in a slot 202 defined in the immovable portion 20. The immovable portion 20 in a side thereof further defines a notch 204 communicating with the slot 202 to allow wires of the temperature sensor in the slot 202 to extend therethrough to connect with the monitoring computer.

Figure 4:
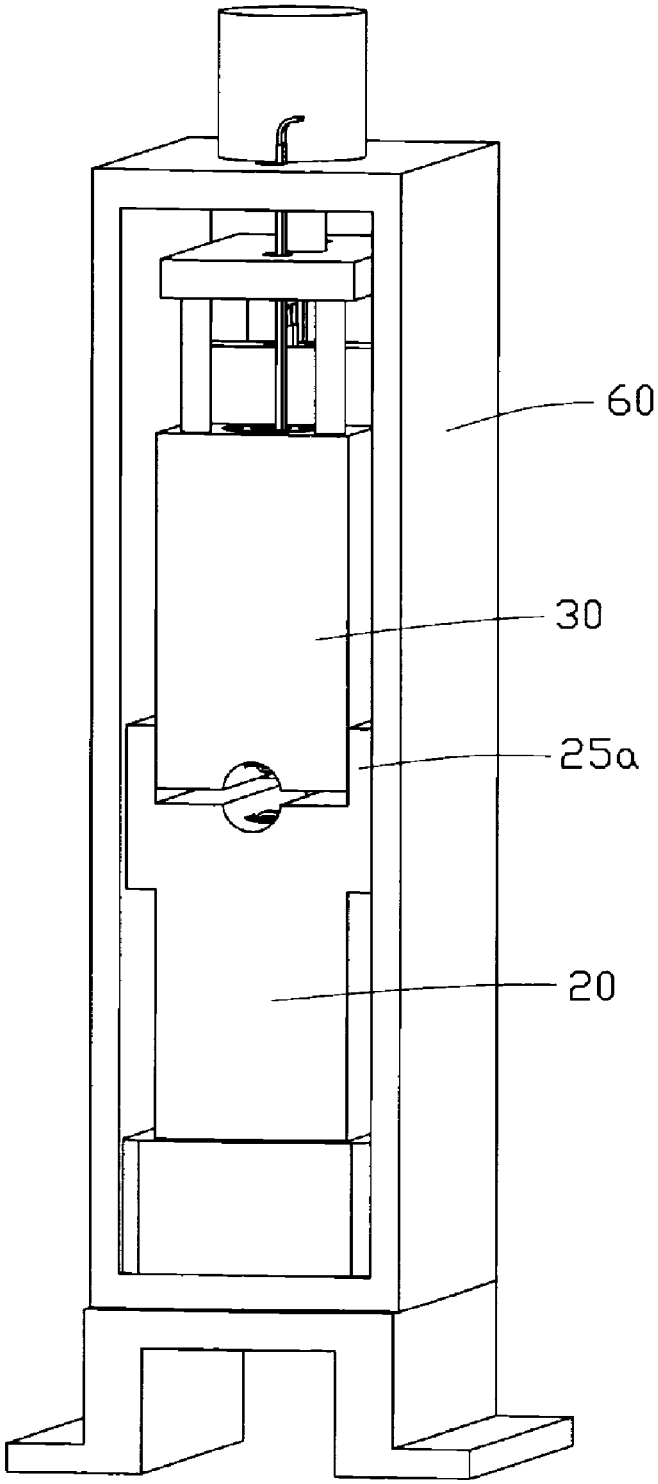
FIG. 4 is an assembled view of a performance testing apparatus for heat pipes in accordance with a second embodiment of the present invention.

Referring to FIG. 4, a performance testing apparatus for heat pipes in accordance with a second embodiment of the present invention is shown. Different from the first embodiment, the immovable portion 20 of the apparatus in accordance with the second embodiment has the flanges 25*a* extending toward the movable portion 30 located on the outer faces of the main body of the immovable portion 20. The main body is located between the two flanges 25*a*. The movable portion 30 is always located between the two flanges 25*a* when it moves away or toward the immovable portion 20 during the test. The two flanges 25*a* contact a pair of the sidewalls of the enclosure 60 to position the immovable portion 20 between the pair sidewalls.

Figure 5A:
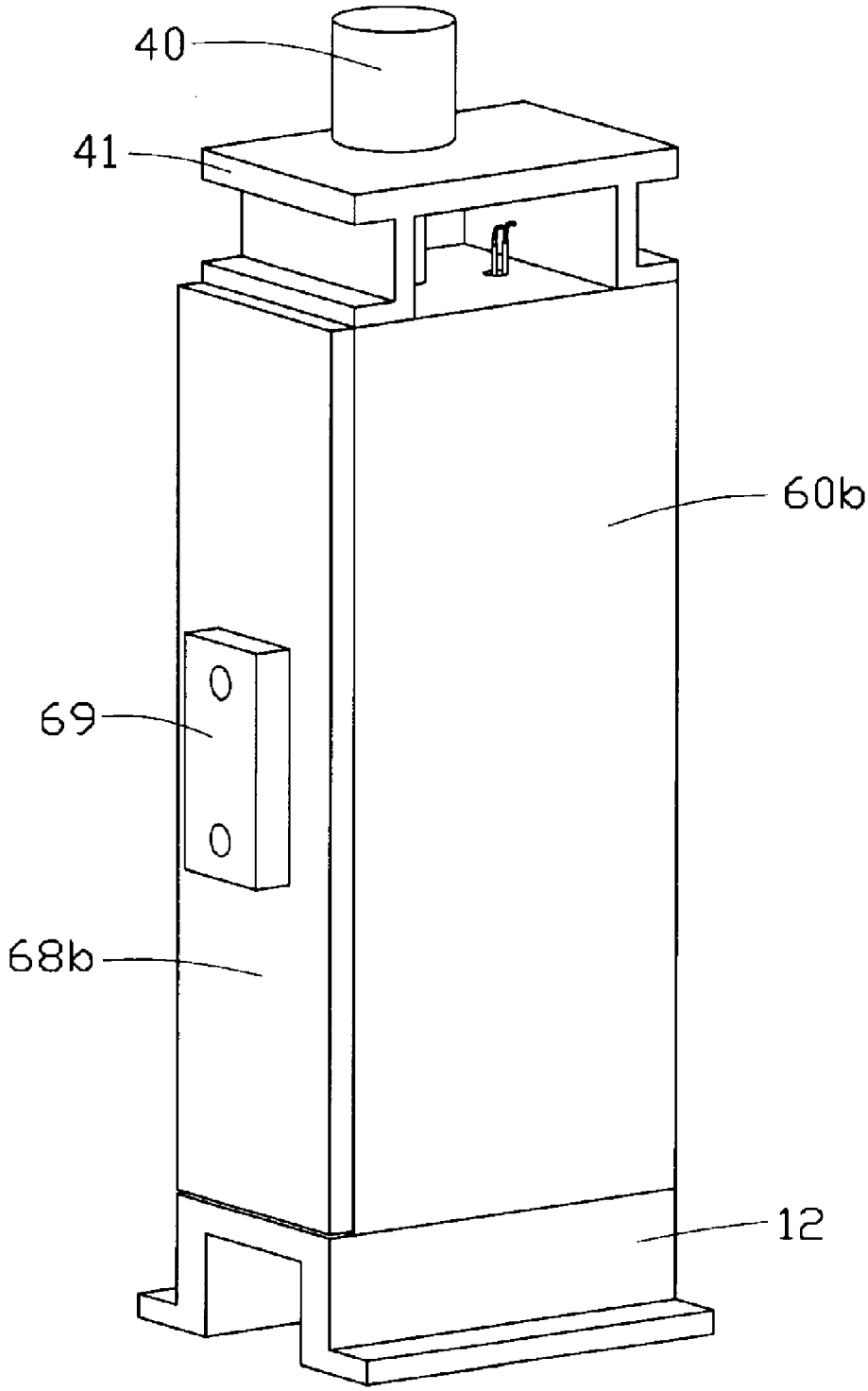
FIG. 5A is an assembled view of a performance testing apparatus for heat pipes in accordance with a third embodiment of the present invention.
Figure 5B:
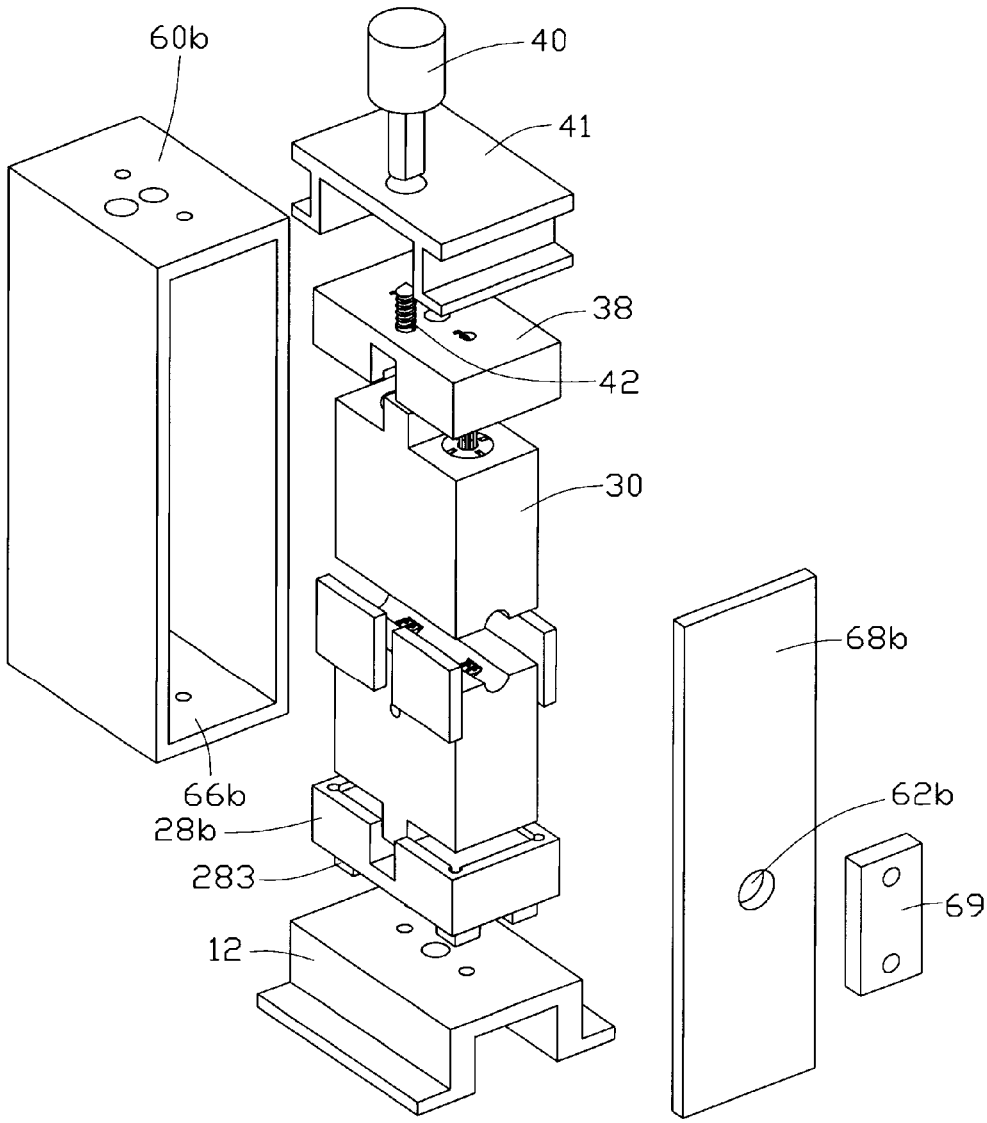
FIG. 5B is an exploded, isometric view of the testing apparatus of FIG. 5A.
Figure 6A:
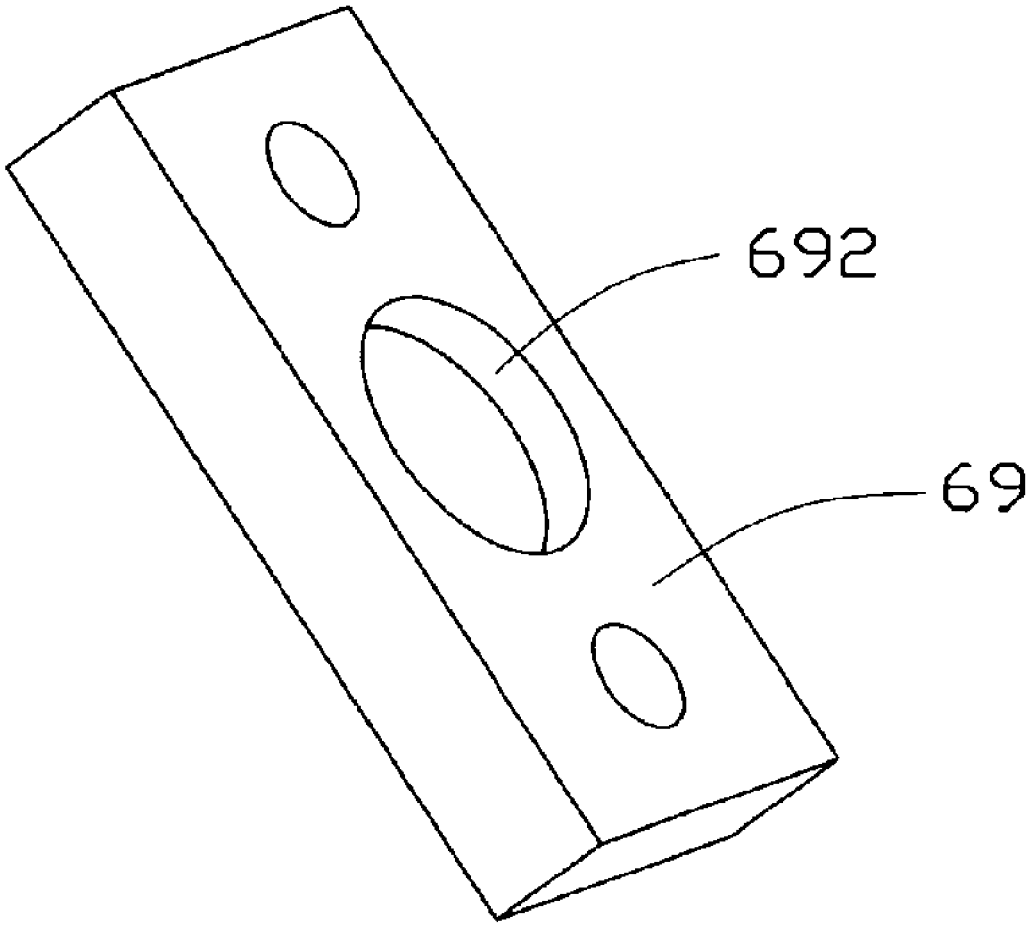
FIG. 6A shows a positioning plate of the testing apparatus of FIG. 5B.
Figure 6B:
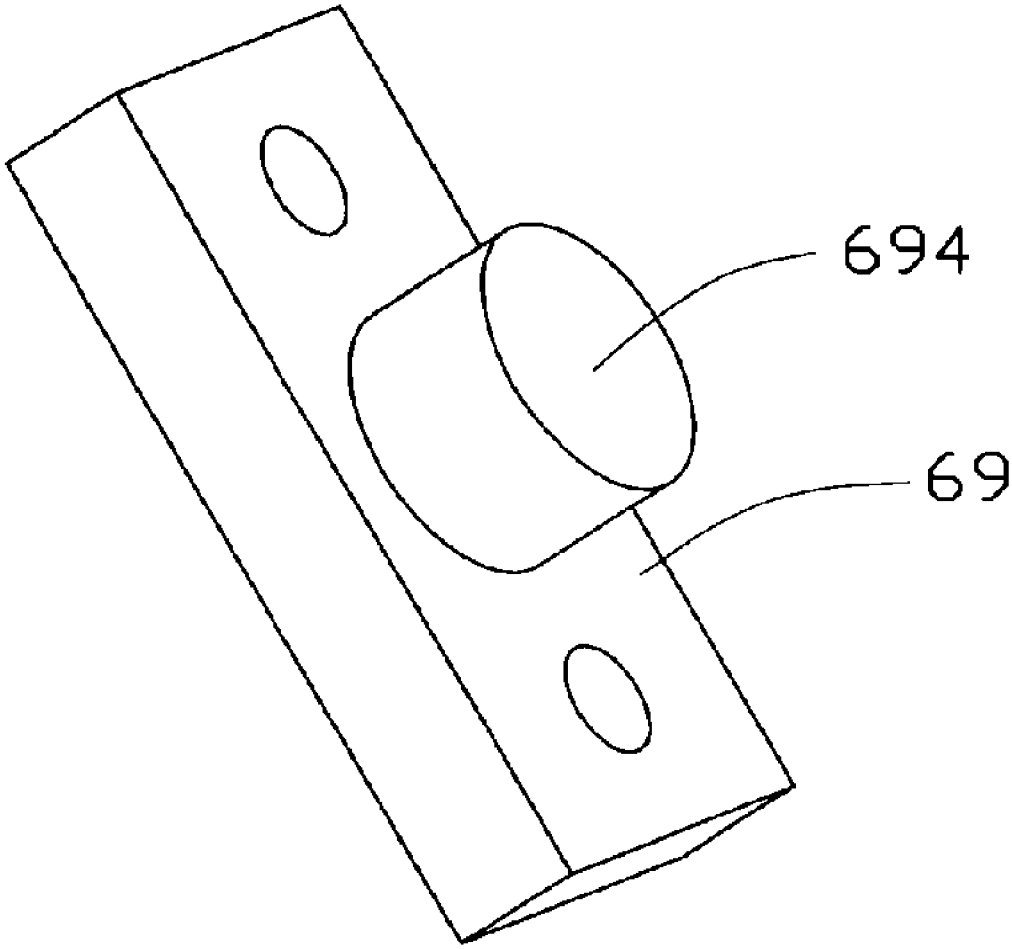
FIG. 6B shows another positioning plate of the testing apparatus of FIG. 5B.

Referring to FIGS. 5A and 5B, a testing apparatus in accordance with a third embodiment of the present invention is shown. The testing apparatus is similar to the first embodiment; main difference therebetween is that an insulating member 28*b* of the third embodiment extends a plurality of feet 283 on the bottom 66*b* of the enclosure 60*b*. The movable portion 30 has a second thermally insulating member 38 which has a configuration identical to the insulating member 28 illustrated in the first embodiment. A second seat 41, which has a configuration similar to the seat 12, is located on the top wall of the enclosure 60*b*. The driving device 40 is positioned on the second seat 41. The shaft of the driving device 40 extends through the second seat 41 and the top wall of the enclosure 60*b* to engage with a bolt 42 fixed to the second insulating member 38. Furthermore, a positioning plate 69 is attached to the door board 68*b* of the enclosure 60*b*. Referring to FIG. 6A, the positioning plate 69 defines a recess 692 in an inner side thereof. The recess 692 is in line with the opening 62*b* of the door board 68*b*, when the evaporating section of the heat pipe needing test is longer than the channel 50 so that an extremity of the evaporating section can be received in the recess 692 when the evaporating section of the heat pipe is inserted into the channel 50 from an opening in a sidewall of the enclosures 60*b* opposite the door board 68*b*. Referring to FIG. 6B, the positioning plate 69 extends a stud 694 into the channel 50 via the opening 62*b* of the door board 68*b*, when the evaporating section of the heat pipe needing test is shorter than the channel 50.

Figure 7:
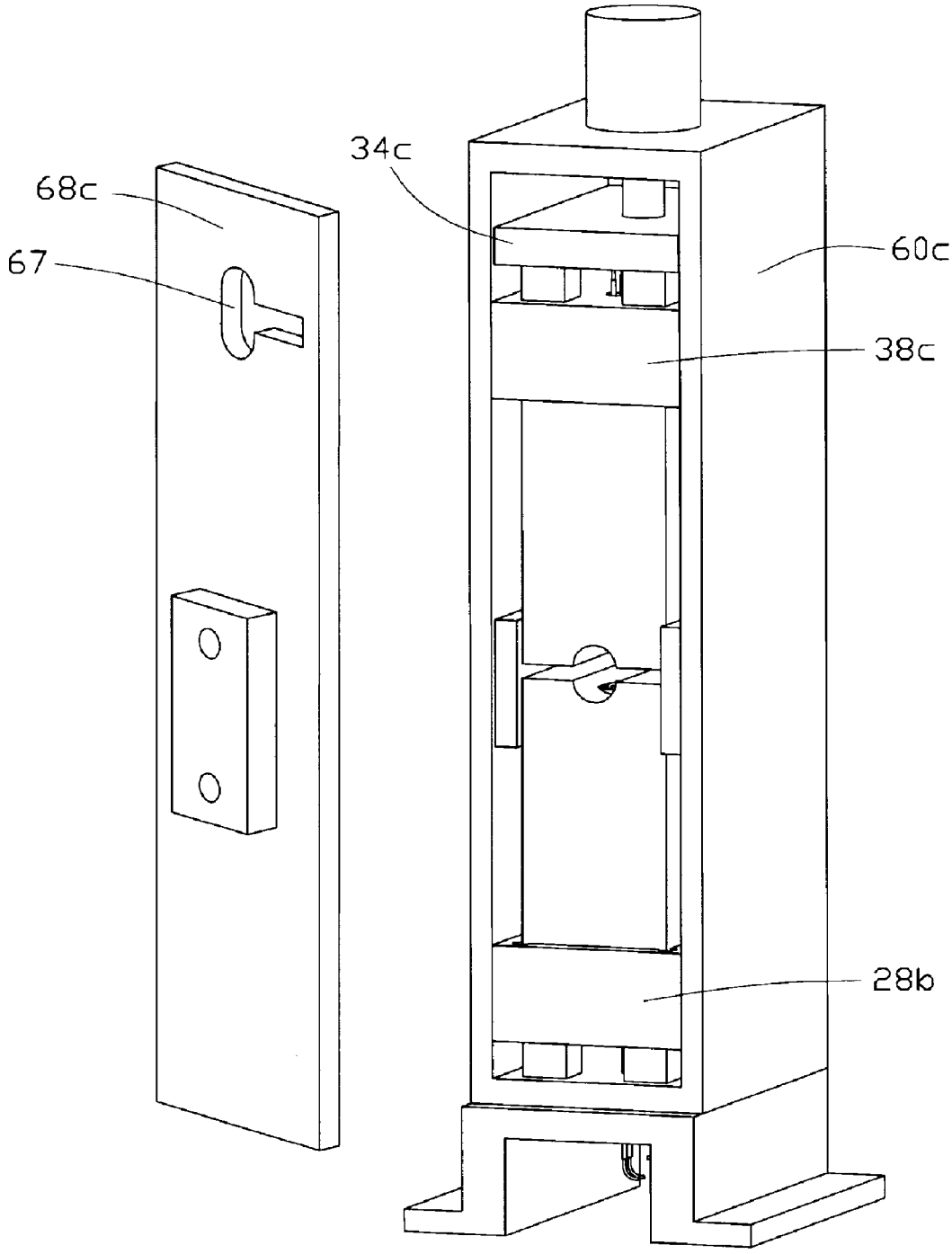
FIG. 7 is an assembled view of the a performance testing apparatus for heat pipes in accordance with a forth embodiment of the present invention.
Figure 8:
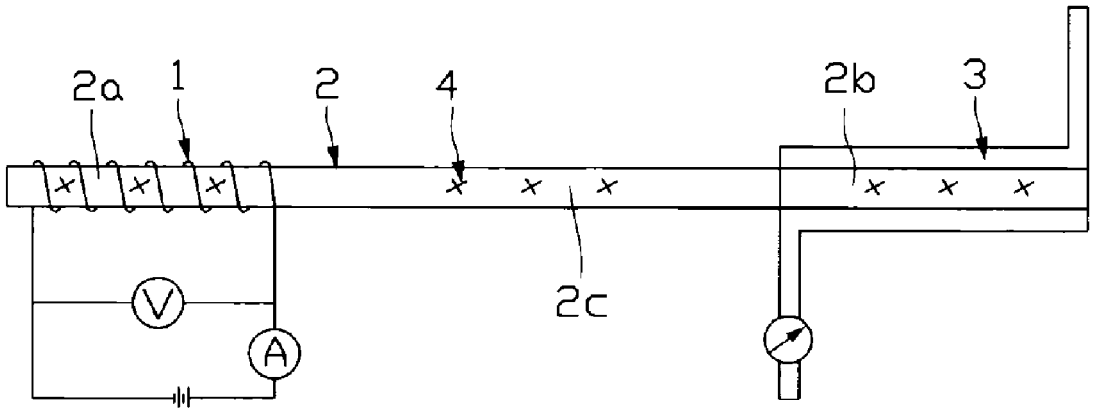
FIG. 8 (RELATED ART)
FIG. 8 is a performance testing apparatus for heat pipes in accordance with related art.

Referring to FIG. 7, a testing apparatus in accordance with a fourth embodiment of the present invention is shown. The testing apparatus is similar to the third embodiment; main difference therebetween is that an insulating member 38*c* of the fourth embodiment positioned on the movable portion 30 is identical to the insulating member 28*b*. Furthermore, a board 34*c* is poisoned on the insulating member 38*c* in the enclosure 60*c*. A port 67 is defined in a door board 68*c* of the enclosure 60*c* for extension of the wires of the temperature sensors 36 and the second heating member of the movable portion 30.

Additionally, in the present invention, in order to lower cost of the testing apparatus, the insulating member 28, 28*b*, 38, 38*c*, the board 34, 34*c*, the positioning socket 262 and the enclosure 60, 60*a*, 60*b*, 60*c* can be made from low-cost material such as PE (Polyethylene), ABS (Acrylonitrile Butadiene Styrene), PF(Phenol-Formaldehyde), PTFE (Polytetrafluoroethylene) and so on. The immovable portion 20 and movable portion 30 can be made from copper (Cu) or aluminum (Al). The immovable portion 20 and movable portion 30 can have silver (Ag) or nickel (Ni) plated on inner faces defining the grooves 24, 32 to prevent the oxidization of the inner faces.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A performance testing apparatus for a heat pipe comprising:

an immovable portion having a first heating member located therein for heating an evaporating section of the heat pipe;

a movable portion capable of moving relative to the immovable portion and having a second heating member located therein for heating the evaporating section of the heat pipe;

a receiving structure being defined between the immovable portion and the movable portion for receiving the evaporating section of the heat pipe therein;

a positioning structure extending from at least one of the immovable portion and the movable portion for avoiding the movable portion from deviating from the immovable portion during movement of the movable portion relative to the immovable portion to ensure the receiving structure being capable of precisely receiving the heat pipe;

at least one temperature sensor being attached to at least one of the immovable portion and the movable portion for thermally contacting the evaporating section of heat pipe in the receiving structure for detecting temperature of the evaporating section of the heat pipe; and an enclosure enclosing the immovable portion and the movable portions therein, and defining a space therein for movement of the movable portion relative to the immovable portion;

wherein the receiving structure is a channel defined between the immovable portion and the movable portion; and wherein the positioning structure is two flanges extending from two opposite sides of the immovable portion toward the movable portion, the two flanges being slidably contacting two opposite faces of the movable portion.

2. The testing apparatus of claim 1, wherein the at least one temperature sensor has a portion thereof exposed to the channel to detect the temperature of the heat pipe.

3. The testing apparatus of claim 1, wherein the movable portion is always located between the two flanges of the immovable portion when it moves away from and toward the immovable portion.

4. The testing apparatus of claim 1 further comprising a seat for positioning the testing apparatus at a required position, wherein the enclosure sits on a supporting plate of the seat.

5. The testing apparatus of claim 4, wherein the seat comprises two spaced supporting feet depending from the supporting plate, a space being defined between the two feet.

6. The testing apparatus of claim 4, wherein the enclosure comprises a bottom sitting on the supporting plate of the seat, a plurality of sidewalls upwardly extending from the bottom, the immovable portion being positioned between a pair of the sidewalls.

7. The testing apparatus of claim 6, wherein the pair of the sidewalls of the enclosure each extends a plurality of ribs abutting against the immovable portion.

8. The testing apparatus of claim 6, wherein the enclosure has a door board removably attached to an opened side thereof, the board and the sidewalls cooperatively defines a room accommodating the immovable portion and the movable portion therein.

9. The testing apparatus of claim 8, wherein the door board and one of the sidewalls of the enclosure each define an opening through which the evaporating section of the heat pipe is disposed into the channel.

10. The testing apparatus of claim 9, wherein the enclosure comprises a positioning plate attached to the door board to adjust a length of the channel.

11. The testing apparatus of claim 10, wherein the positioning plate defines a recess in line with the channel.

12. The testing apparatus of claim 10, wherein the positioning plate extends a stud into the channel via the opening in the door board.

13. The testing apparatus of claim 6 further comprising a thermally insulating member located between the immovable portion and the bottom of the enclosure.

14. The testing apparatus of claim 13, wherein the insulating member receives a bottom of the immovable portion therein, and extends a plurality of ribs upwardly from a bottom of the insulating member to support the immovable portion thereon so that the immovable portion is spaced from the bottom of the insulating member.

15. The testing apparatus of claim 6 further comprising a driving device mounted on a top wall of the enclosure, wherein the driving device connects with the movable portion and is capable of driving the movable portion to move away and towards the immovable portion in the enclosure.

16. The testing apparatus of claim 1, wherein the first heating member of the immovable portion is accommodated in a hole defined in the immovable portion, and extends two wires to connect with a power supply.

17. The testing apparatus of claim 16, wherein the second heating member of the movable portion is accommodated in a hole defined in the movable portion, and extends two wires to connect with a power supply.

18. The testing apparatus of claim 1 further comprising a temperature sensor for measuring temperature of the immovable portion.

19. A performance testing apparatus for a heat pipe and a seat for positioning the testing apparatus comprising:

an immovable portion having a first heating member located therein for heating an evaporating section of the heat pipe;

a movable portion capable of moving relative to the immovable portion and having a second heating member located therein for heating the evaporating section of the heat pipe;

a receiving structure being defined between the immovable portion and the movable portion for receiving the evaporating section of the heat pipe therein;

a positioning structure extending from at least one of the immovable portion and the movable portion for avoiding the movable portion from deviating from the immovable portion during movement of the movable portion relative to the immovable portion to ensure the receiving structure being capable of precisely receiving the heat pipe;

at least one temperature sensor being attached to at least one of the immovable portion and the movable portion for thermally contacting the evaporating section of heat pipe in the receiving structure for detecting temperature of the evaporating section of the heat pipe;

an enclosure enclosing the immovable portion and the movable portions therein, and defining a space therein for movement of the movable portion relative to the immovable portion; and a seat for positioning the testing apparatus at a required position, wherein the enclosure sits on a supporting plate of the seat;

wherein the receiving structure is a channel defined between the immovable portion and the movable portion.

* * * * *

UNITED STATES PATENT AND TRADEMARK OFFICE

CERTIFICATE OF CORRECTION

PATENT NO. : 7,632,010 B2
APPLICATION NO. : 11/309567
DATED : December 15, 2009
INVENTOR(S) : Liu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 461 days.

Signed and Sealed this

Second Day of November, 2010

David J. Kappos

David J. Kappos
*Director of the United States Patent and Trademark Office*